US006318473B1

(12) United States Patent
Bartley et al.

(10) Patent No.: US 6,318,473 B1
(45) Date of Patent: Nov. 20, 2001

(54) EXPANSIVE FIRE EXTINGUISHING SYSTEM

(76) Inventors: Talmadge O. Bartley; Louise G. Bartley; G. Katye Bartley, all of 4118 Hemlock St., San Diego, CA (US) 92113-1821

( * ) Notice: Subject to any disclaimer, the term of this patent is extended or adjusted under 35 U.S.C. 154(b) by 0 days.

(21) Appl. No.: 09/641,851

(22) Filed: Aug. 18, 2000

(51) Int. Cl.[7] ..... A62C 37/10; A62C 35/02

(52) U.S. Cl. ..... 169/26; 169/28; 169/30; 169/35; 169/36; 169/60

(58) Field of Search ..... 169/30, 35, 36, 169/26, 28, 45, 46, 47, 60

(56) References Cited

U.S. PATENT DOCUMENTS

| | | | | |
|---|---|---|---|---|
| 333,117 | * | 12/1885 | Ely | 169/28 |
| 338,604 | * | 3/1886 | Luyster | 169/28 |
| D. 355,744 | | 2/1995 | Small et al. . | |
| 357,719 | * | 2/1887 | Letson | 169/28 X |
| 1,317,551 | * | 9/1919 | Chambers | 169/36 X |
| 1,928,909 | | 10/1933 | Reasor . | |
| 2,306,321 | | 12/1942 | Roberts . | |
| 2,359,573 | * | 10/1944 | MacKay | 169/36 X |
| 2,873,806 | | 2/1959 | Bittner . | |
| 3,369,609 | | 2/1968 | Fogelgren . | |
| 3,677,347 | * | 7/1972 | Rosen et al. | 169/1 |
| 3,980,139 | * | 9/1976 | Kirk | 169/28 |
| 4,037,665 | | 7/1977 | Hopper . | |
| 4,285,403 | | 8/1981 | Poland . | |
| 4,344,489 | | 8/1982 | Bonaparte . | |
| 4,964,469 | | 10/1990 | Smith . | |
| 5,050,683 | * | 9/1991 | Sayles | 169/46 |
| 5,507,350 | | 4/1996 | Primlani . | |
| 5,778,984 | * | 7/1998 | Suwa | 166/36 |
| 5,894,891 | | 4/1999 | Rosenstock et al. . | |

* cited by examiner

*Primary Examiner*—Robin O. Evans

(57) ABSTRACT

An expansive fire extinguishing system for combating forest and brush fires at safe distances. The expansive fire extinguishing system includes a sealed and explodable container capable of being moved airborne to distant fires; and also includes fire extinguishing agents disposed in the sealed and explodable container; and further includes a manner of opening the sealed and explodable container to release the fire extinguishing agents disposed inside thereof.

1 Claim, 3 Drawing Sheets

EXPANSIVE FIRE EXTINGUISHING SYSTEM

BACKGROUND OF THE INVENTION

1. Field of the Invention

The present invention relates to a forest fire self-destruct technology and more particularly pertains to a new expansive fire extinguishing system for combating forest and brush fires at safe distances.

2. Description of the Prior Art

The use of a forest fire self-destruct technology is known in the prior art. More specifically, a forest fire self-destruct technology heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,964,469; U.S. Pat. No. 4,037,665; U.S. Pat. No. 4,285,403; U.S. Pat. No. 5,894,891; U.S. Pat. No. 4,344,489; U.S. Pat. No. Des. 335,744; U.S. Pat. No. 1,928,909; U.S. Pat. No. 2,306,321; U.S. Pat. No. 2,873,806; U.S. Pat. No. 3,369,609; and U.S. Pat. No. 5,507,350.

While these devices fulfill their respective, particular objectives and requirements, the aforementioned patents do not disclose a new expansive fire extinguishing system. The inventive device includes a sealed and explodable container capable of being moved airborne to distant fires; and also includes fire extinguishing agents disposed in the sealed and explodable container; and further includes a manner of opening the sealed and explodable container to release the fire extinguishing agents disposed inside thereof.

In these respects, the expansive fire extinguishing system according to the present invention substantially departs from the conventional concepts and designs of the prior art, and in so doing provides an apparatus primarily developed for the purpose of combating forest and brush fires at safe distances.

SUMMARY OF THE INVENTION

In view of the foregoing disadvantages inherent in the known types of forest fire self-destruct technology now present in the prior art, the present invention provides a new expansive fire extinguishing system construction wherein the same can be utilized for combating forest and brush fires at safe distances.

The general purpose of the present invention, which will be described subsequently in greater detail, is to provide a new expansive fire extinguishing system which has many of the advantages of the forest fire self-destruct technology mentioned heretofore and many novel features that result in a new expansive fire extinguishing system which is not anticipated, rendered obvious, suggested, or even implied by any of the prior art forest fire self-destruct technology, either alone or in any combination thereof.

To attain this, the present invention generally comprises a sealed and explodable container capable of being moved airborne to distant fires; and also includes fire extinguishing agents disposed in the sealed and explodable container; and further includes a manner of opening the sealed and explodable container to release the fire extinguishing agents disposed inside thereof.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new expansive fire extinguishing system which has many of the advantages of the forest fire self-destruct technology mentioned heretofore and many novel features that result in a new expansive fire extinguishing system which is not anticipated, rendered obvious, suggested, or even implied by any of the prior art forest fire self-destruct technology, either alone or in any combination thereof.

It is another object of the present invention to provide a new expansive fire extinguishing system which may be easily and efficiently manufactured and marketed.

It is a further object of the present invention to provide a new expansive fire extinguishing system which is of a durable and reliable construction.

An even further object of the present invention is to provide a new expansive fire extinguishing system which is susceptible of a low cost of manufacture with regard to both materials and labor, and which accordingly is then susceptible of low prices of sale to the consuming public, thereby making such expansive fire extinguishing system economically available to the buying public.

Still yet another object of the present invention is to provide a new expansive fire extinguishing system which provides in the apparatuses and methods of the prior art some of the advantages thereof, while simultaneously overcoming some of the disadvantages normally associated therewith.

Still another object of the present invention is to provide a new expansive fire extinguishing system for combating forest and brush fires at safe distances.

Yet another object of the present invention is to provide a new expansive fire extinguishing system which includes a sealed and explodable container capable of being moved airborne to distant fires; and also includes fire extinguishing agents disposed in the sealed and explodable container; and further includes a manner of opening the sealed and explodable container to release the fire extinguishing agents disposed inside thereof.

Still yet another object of the present invention is to provide a new expansive fire extinguishing system that provides a high degree of precision and concentration.

Even still another object of the present invention is to provide a new expansive fire extinguishing system that applies fire extinguishing agents towards the base of the fire with minimal losses due to evaporation and updraft flow unlike the conventional air drops using water.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
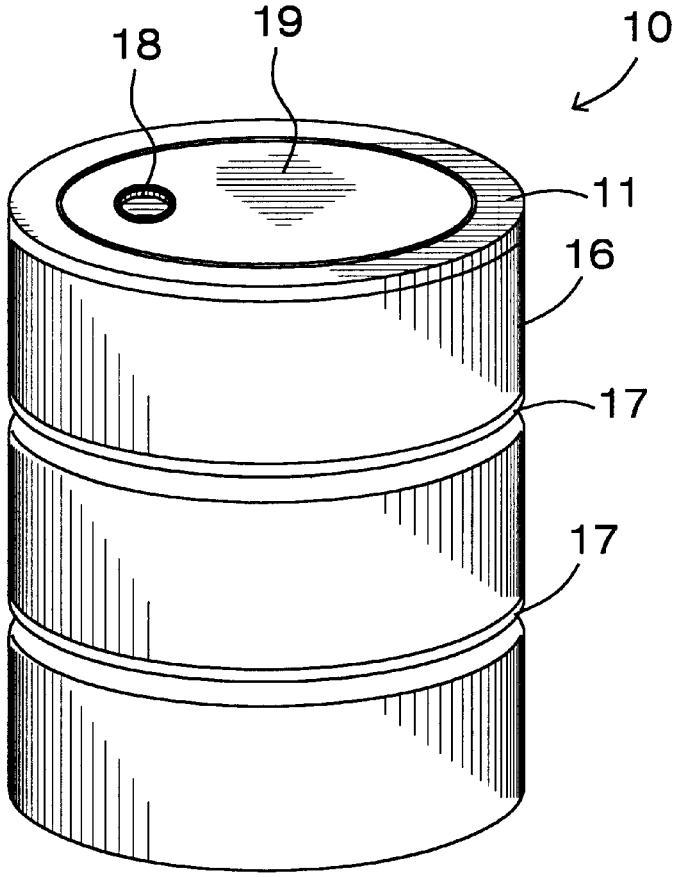
FIG. 1 is a perspective view of a container or drum of a new expansive fire extinguishing system according to the present invention.
Figure 2:
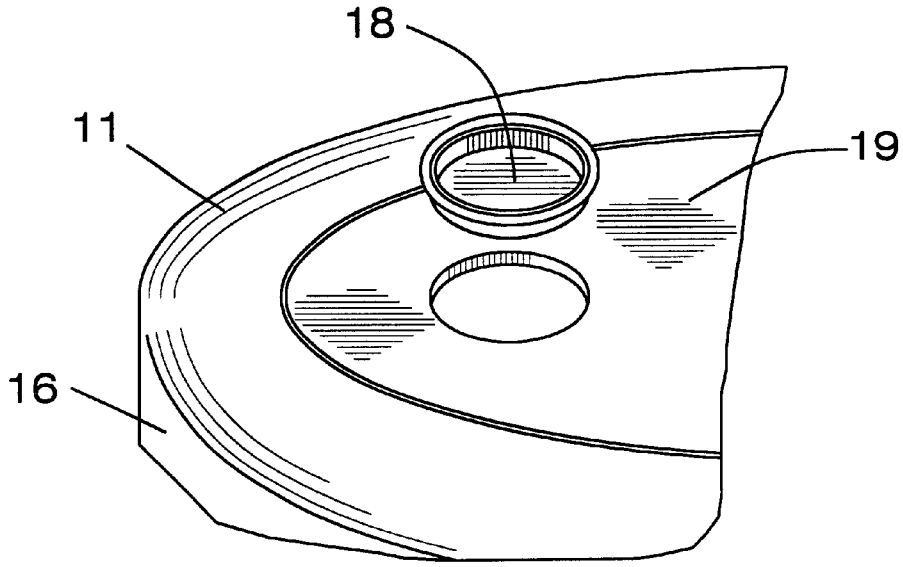
FIG. 2 is a partial perspective view of the container or drum of the present invention.
Figure 3:
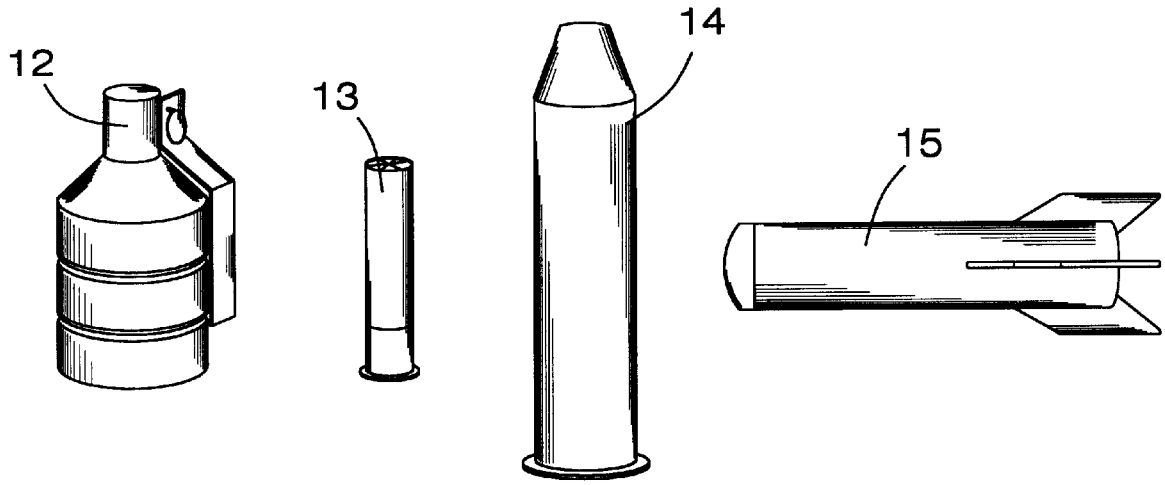
FIG. 3 are perspective views of other containers of the present invention.
Figure 4:
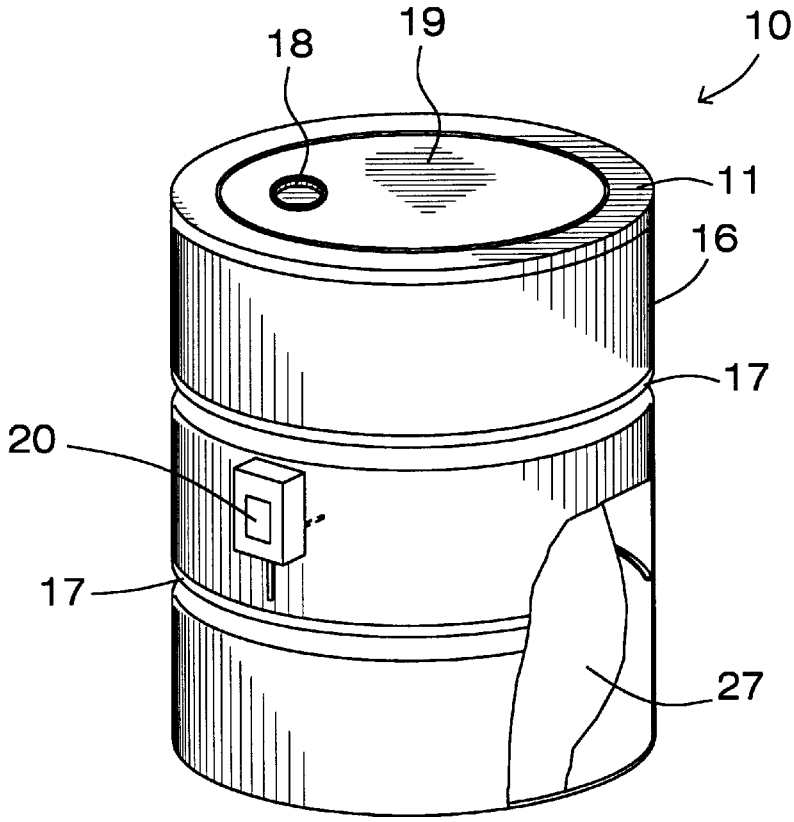
FIG. 4 is a perspective view of the container or drum with a heat activated sensor of the present invention.
Figure 5:
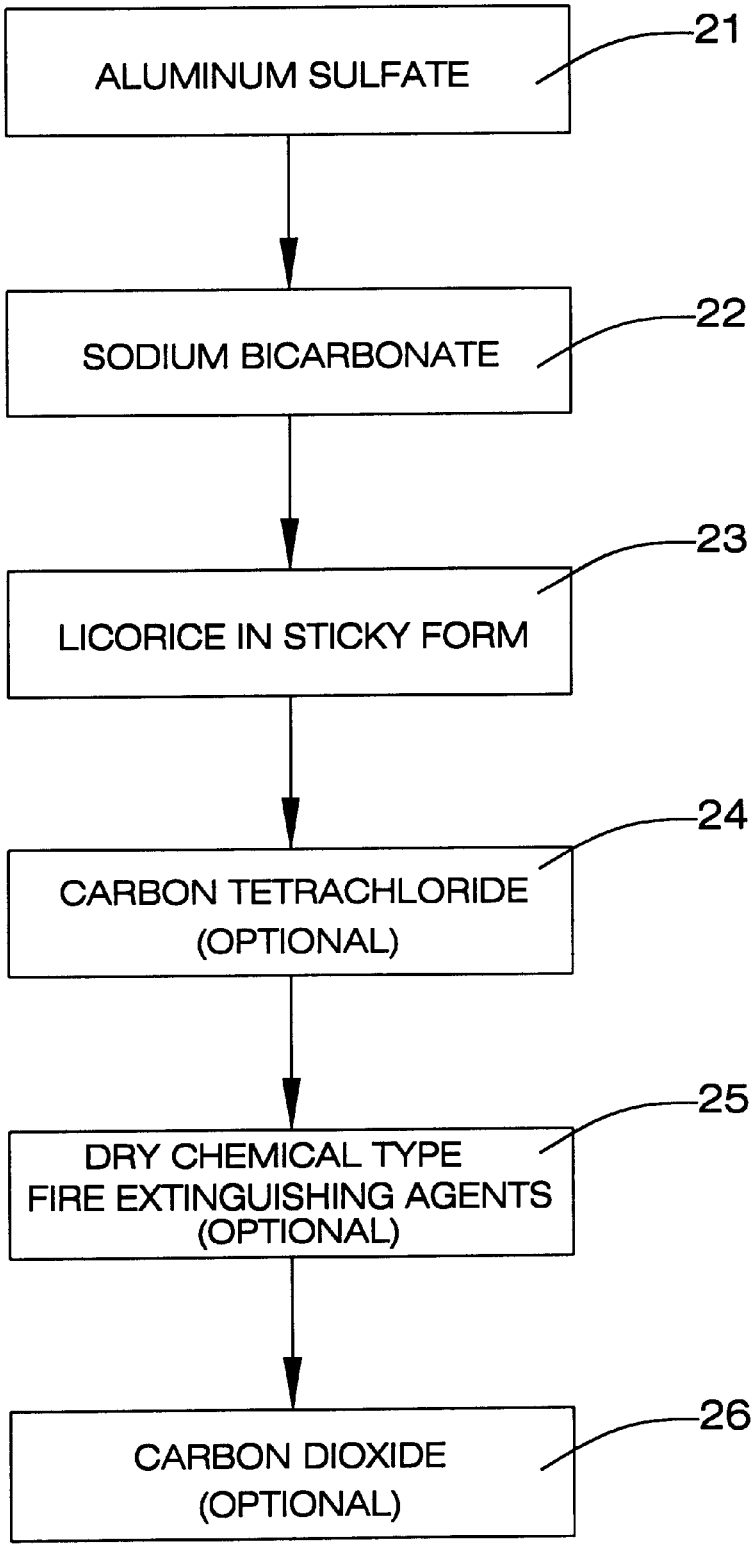
FIG. 5 is a schematic diagram of the fire extinguishing agents of the present invention.

With reference now to the drawings, and in particular to FIGS. 1 through 5 thereof, a new expansive fire extinguishing system embodying the principles and concepts of the present invention and generally designated by the reference numeral 10 will be described.

As best illustrated in FIGS. 1 through 5, the expansive fire extinguishing system 10 generally comprises a sealed and explodable container 11–15 capable of being moved airborne to distant fires. The sealed and explodable container 11–15 includes a drum 11 having a side wall 16 with reinforced ribs 17 being spaced apart and encircling the side wall 16 and with the drum 11 also having an end wall 19 with an opening therein. The opening is closeable with a sealed pressure cap 18. The sealed and explodable container 11–15 also includes an air missile 15, a rifle cartridge 13, a hand grenade 12, and a mortar shell 14.

Fire extinguishing agents 27 are disposed in the sealed and explodable container 11–15 and they include a mixture of licorice 23 provided in a sticky form, sodium bicarbonate 22, and aluminum sulfate 21 with the fire extinguishing agents 27 further including carbon tetrachloride 24, dry chemicals 25, and carbon dioxide 26.

A means of opening the sealed and explodable container 11–15 to release the fire extinguishing agents 27 disposed inside thereof including an explosive 20 securely attached to the sealed and explodable container 11–15. The means for opening the sealed and explodable container 11–15 further includes a heat activated sensor 20 being securely and conventionally attached to an exterior wall 16 of the container 11–15 and being adapted to explode upon sensing extreme heat as produced from fires. The means for opening the sealed and explodable container 11–15 also includes dropping the sealed and explodable container 11–15 from an airplane and contacting and cracking open the sealed and explodable container 11–15 upon a ground.

In use, the sealed and explodable container 11–15 is placed at a base of the fire either by air dropping the container 11–15 to the ground or by placing the container 11–15 in the path of the fire, whereupon the container 11–15 is opened with either an explosive device 20 or by being cracked opened upon hitting the ground after being dropped from the air which will release the fire extinguishing agents 27 to the fire.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An expansive fire extinguishing system comprising:

a sealed and explodable container capable of being moved airborne to distant fires, said sealed and explodable container including a drum having a side wall with reinforced ribs being spaced apart and encircling said side wall, said drum also having an end wall with an opening therein, said opening being closeable with a sealed pressure cap fire extinguishing agents disposed in said sealed and explodable container, said fire extinguishing agents including a mixture of licorice provided in a sticky form, sodium bicarbonate, and aluminum sulfate, said fire extinguishing agents further including carbon tetrachloride, and carbon dioxide; and a means of opening said sealed and explodable container to release said fire extinguishing agents disposed inside thereof, said means for opening said sealed and explodable container being securely attached to an exterior wall of said container, said means of opening said sealed and explodable container including an explosive securely attached to said sealed and explodable container, said means for opening said sealed and explodable container further including a heat activated sensor being securely attached to an exterior wall of said container and adapted to explode upon sensing extreme heat to rupture the container to disperse the fire extinguishing agents.

* * * * *